US005979789A

United States Patent [19]

Sullivan et al.

[11] Patent Number: 5,979,789

[45] Date of Patent: Nov. 9, 1999

[54] FUEL INJECTOR WITH INTERNAL COMPONENT LOAD PROTECTION

[75] Inventors: Jeffrey J. Sullivan, Columbus; John D. Crofts, Edinburgh; Harry L. Wilson, Columbus; George L. Muntean, Columbus; Kevin L. Vogt, Columbus; Mustahsen Gull, Columbus; John L. Long, Trafalgar, all of Ind.

[73] Assignee: Cummins Engine Company, Inc., Columbus, Ind.

[21] Appl. No.: 08/978,579

[22] Filed: Nov. 26, 1997

[51] Int. Cl.[6] ..... F02M 47/02

[52] U.S. Cl. ..... 239/88; 239/124

[58] Field of Search ..... 239/585.1, 88, 239/92, 585.4, 600, 124, 127, 125; 251/129.21

[56] References Cited

U.S. PATENT DOCUMENTS

| | | | |
|---|---|---|---|
| 4,280,659 | 7/1981 | Gaal et al. . | |
| 4,295,453 | 10/1981 | Seilly et al. | 239/88 |
| 4,306,680 | 12/1981 | Smith | 239/585.1 |
| 4,408,718 | 10/1983 | Wich | 239/585.1 |
| 4,482,094 | 11/1984 | Knape . | |
| 4,741,478 | 5/1988 | Teerman et al. . | |
| 5,082,180 | 1/1992 | Kubo et al. . | |
| 5,094,215 | 3/1992 | Gustafson . | |
| 5,277,400 | 1/1994 | Bierther | 239/585.1 |
| 5,301,875 | 4/1994 | Gant et al. . | |
| 5,341,783 | 8/1994 | Beck et al. . | |
| 5,360,164 | 11/1994 | Pape et al. | 239/88 |
| 5,535,723 | 7/1996 | Gibson et al. . | |
| 5,628,293 | 5/1997 | Gibson et al. | 239/88 |

*Primary Examiner*—Kevin Weldon
*Attorney, Agent, or Firm*—Sixbey, Friedman, Leedom & Ferguson; Charles M. Leedom, Jr.; Tim L. Brackett, Jr.

[57] ABSTRACT

A fuel injector for effectively preventing excessive loading of a component mounted internal to the injector is provided which includes a one-piece retainer having first and second connector portions for permitting two independent loads to be applied to different internal components of the injector. The second connector portion includes threads for engaging a nozzle assembly to impart a compressive force on the nozzle assembly. The first connector portion also includes threads for engaging an outer barrel for placing a first compressive load on a load sensitive internal component, such as a center tube of an injection control valve. In this manner, the second compressive force can be set at a minimum level independent from the first compressive force to permit the size of the center tube to be minimized thereby reducing the overall size of the injector. Also, a locking device including a locking ring for engaging the outer barrel ensures a secure connection between the second connector portion and the outer barrel to prevent shifting at the connection during operation of the injector as the load at the connection transitions from a tension load to a compression load thereby ensuring only a minimum load on the center tube. A novel sealing assembly is also provided to permit effective sealing between the end of the center tube and the outer barrel regardless of tolerance variations while providing simplified valve stroke setting capability.

24 Claims, 3 Drawing Sheets

(TENSION)
FORCE (lbs)
(COMPRESSION)
10000
8000
6000
4000
2000
0
-2000
-4000
-6000
-8000
-10000
-12000
-14000
LOWER RETAINER PORTION
UPPER RETAINER PORTION
CENTER TUBE
1650 lbs max
LOWER NOZZLE ASSEMBLY (SPRING HOUSING)
LOWER RETAINER PORTION 150 ft-lbs
UPPER RETAINER PORTION 7.5 ft-lbs
LOCKING RING 150 ft-lbs
CLAMP LOAD 2500 LBS
PUMPING LOAD 6000 psi
PUMPING LOAD 12000 psi
PUMPING LOAD 30000 psi

FUEL INJECTOR WITH INTERNAL COMPONENT LOAD PROTECTION

TECHNICAL FIELD OF THE INVENTION

The present invention relates to a fuel injector which avoids high axial loading, caused by, for example, fuel pressure forces and mounting forces, of certain internal components thereby permitting the size of the components to be minimized to create a more compact injector while maintaining fast response and high pressure injection capability.

BACKGROUND OF THE INVENTION

Fuel injection into the cylinders of an internal combustion engine is most commonly achieved using fuel injectors. A commonly used injector is a closed nozzle injector which includes a nozzle assembly having a spring-biased nozzle valve element positioned adjacent the nozzle orifices for resisting blow back of exhaust gas into the injector while allowing fuel to be injected into the cylinder. The nozzle valve also functions to provide a deliberate, abrupt end to fuel injection thereby preventing a secondary injection which causes unburned hydrocarbons in the exhaust.

Recent and upcoming legislation resulting from a concern to improve fuel economy and reduce emissions continues to place strict emissions standards on engine manufacturers. In order for new engines to meet these standards, it is necessary to produce fuel injection systems capable of achieving higher injection pressures, controlled injection rates and fast response while maintaining accurate and reliable control of fuel metering and injection timing functions. As a result, closed-nozzle injectors are undergoing structural modifications which better enable the injectors to produce and withstand the higher injection pressures. However, these improvements often undesirably increase the size of the injector which must conform to overall size restrictions or packaging constraints dictated by the mounting arrangement on a particular engine. Also, as injection pressures increase, greater forces must be applied to the injector components of the injector body to achieve the required sealing at the component interfaces/joints. However, injectors often include internal components which are sensitive to the load applied to the component.

For example, one way of achieving the goal of high pressure and controlled injection metering and timing is to incorporate an injection control valve in the injector body for controlling timing and quantity of injection. These injectors may be "unit" injectors which conventionally include a positive displacement plunger driven by a cam mounted on an engine drive camshaft. U.S. Pat. No. 4,482,094 to Knape and U.S. Pat. No. 4,741,478 to Teerman et al. both disclose closed-nozzle, electromagnetic unit fuel injectors including a single, cam-operated injector plunger and a solenoid controlled valve for controlling the beginning and end of injection and thus, the timing and quantity of fuel injected during each cycle of plunger movement. The solenoid controlled valve operates to allow fuel to flow into and out of a pumping/metering chamber of the unit injector when open but traps fuel in the chamber when closed to cause the injector plunger to force fuel through the injector nozzle into an associated combustion chamber of the engine. With this construction, the solenoid controlled valve is normally biased into an open position to allow excess fuel to be discharged from the pumping/metering chamber to a drain passage while the nozzle valve is biased into a closed position. Upon movement of the solenoid operated valve to a closed condition, a sufficient pressure will build up so as to displace the nozzle valve and allow the injection of fuel to commence.

Although the injectors of Knape and Teerman et al. function to provide sufficient fuel injection capability, both injectors subject the injection control valve components to excessively high axial forces. The internal components of the injector including the actuator, e.g. center tube or control valve cage, are compressively held together between an outer retainer and an upper barrel. In addition, clamping forces, applied to the injector to secure the injector to the cylinder head of an engine, also may act on the control valve assembly. In addition, the fuel pressure in the pumping chamber, created by the cam-operated plunger, imparts a hydraulic force on the control valve assembly. As a result, the control valve components and housing must be formed of sufficient size and strength to withstand such forces, or risk distortion and damage, and thus possible valve malfunction. Consequently, these existing assemblies are unnecessarily large, robust and expensive.

The Knape and Teerman injectors also suffer from other disadvantages. For example, in the Knape design, the coil of the solenoid is arranged concentrically around the injector plunger. Therefore, the solenoid coil inner diameter is determined by the diameter of the injector plunger. As a result, the solenoid coil and fuel injector body have an unnecessarily large diameter. This design results in the loss of space available to the engine intake and exhaust valves. In addition, the armature/control valve arrangement utilizes the magnetic lines of force of the outer pole of the stator positioned beyond the outer radial extent of the coil. Since the armature must be positioned closely adjacent to these outer poles to generate the force requirements of the valve, the armature is required to be larger than the outside diameter of the coil. This large armature mass increases the effects of inertia thereby undesirably increasing response time. The solenoid actuator of the Teerman et al. injector is positioned axially between the injector plunger and the normally closed nozzle tip valve. However, although decreasing the outer diameter of the injector body, this axial arrangement created a fuel injector body having an undesirably large axial length. In addition, the Teerman et al. injector includes a solenoid actuator which utilizes the magnetic lines of force adjacent the outer pole requiring a relatively large armature thereby causing a decrease in response time.

Another disadvantage of the prior art discussed above is that the valve seat of the solenoid operated control valve is positioned a relatively large distance from the pumping/metering chamber. This arrangement increases the length of the fuel transfer passages thereby increasing the compressed fuel volume and, consequently, the response time.

U.S. Pat. No. 5,082,180 to Kubo et al. discloses a closed nozzle injector having an electromagnetic injection control valve which includes a tubular valve member and armature slidably mounted on a guide or center tube member wherein the armature, a stator and an armature biasing spring are located between the pumping chamber and nozzle assembly. The components of the nozzle assembly are held in compressive abutment by threadably connecting an auxiliary retainer to a spring holder to securely engage a main retainer. The control valve assembly is securely positioned in the main retainer by threadably connecting the main retainer to the injector body. However, the threaded connection between the main retainer and the injector body may shift or become loose due to the load on the main retainer transitioning between tension and compression as the plunger reciprocates. As a result, an unnecessarily large amount of axial loading may be imparted to the center tube. This large axial load causes the center tube to dilate and shorten resulting in binding of the valve element and possible shortening of the valve stroke. If the diameter of the center tube is increased to withstand increased loading, the increased size of the center tube/valve element interface allows the injection pressure to cause dilation of the valve element thereby adversely affecting valve movement and seating. Also, this two-piece retainer design unnecessarily results in an excessive number of injector parts. Moreover, the armature sleeve and biasing spring are positioned in a non-overlapping manner with the solenoid stator along the axis of the injector. Thus, the injector in Kubo et al. has an undesirably large axial length which increases response time and high pressure capability due to the length of the high pressure passages. Also, proper alignment and sealing is required at both ends of the center tube and is difficult to achieve due to differences in manufacturing tolerances.

Consequently, there is a need for a compact, inexpensive unit fuel injector having an injection control valve mounted in the injector body which avoids high axial loading of certain internal components, such as the injection control valve, caused by, for example, fuel pressure forces and mounting forces.

SUMMARY OF THE INVENTION

In view of the foregoing, it is an object of the present invention, therefore, to overcome the disadvantages of the prior art and to provide an improved fuel injector of a simple and compact design with fast response and high pressure capability.

It is a further object of the present invention to provide an improved fuel injector including a load sensitive internal component which minimizes the load applied to the load sensitive internal component upon assembly and during operation.

It is yet another object of the present invention to provide an improved fuel injector including an injection control valve which minimizes the size of the injection control valve components to minimize the size and weight of the injector.

It is yet a further object of the present invention to provide an improved fuel injector having an injection control valve which includes a center tube and a control valve sleeve wherein the load on, and the diameter of, the center tube is minimized.

It is also an object of the present invention to provide an improved, closed-nozzle fuel injector having an electromagnetic fuel injector control valve including a center tube which can be reliably positioned in sealed abutment against an injector component regardless of slight misalignment due to tolerances.

Another object of the present invention is to provide an improved fuel injector including a closed nozzle assembly and an injection control valve wherein the nozzle assembly can be secured by a high compressive force while the injection control valve can be secured and sealed in position by low compressive forces.

Still another object of the present invention is to provide an improved fuel injector which minimizes the number of injector parts and high pressure joints.

Yet another object of the present invention is to provide a fuel injector with an integral injection control valve which minimizes the manufacturing costs associated with precision machining the components.

It is still another object of the present invention is to provide a fuel injector with an integral injection control valve which provides a simple manner of setting injection control valve stroke.

These, as well as other objects of the present invention are achieved by providing a fuel injector adapted to inject fuel at high pressure into the combustion chamber of an engine, comprising an injector body including a retainer forming a retainer cavity and an outer barrel, said retainer including a first connector portion for secure engagement with the outer barrel and a second connector portion positioned along the retainer a spaced distance from the first connector portion. The injector also includes a nozzle assembly mounted in one end of the retainer cavity which includes a nozzle housing, an injector orifice formed in the nozzle housing for directing fuel into the combustion chamber, a nozzle valve element for controlling fuel flow through the nozzle orifice and a spacer securely connected to the second connector portion to cause the nozzle housing to compressively abut the retainer with a first predetermined force. The injector also includes a load sensitive internal component positioned in the retainer cavity axially between the spacer and the outer barrel. The outer barrel engages the first connector portion to apply a second predetermined compressive force to the load sensitive internal component wherein the second predetermined compressive force is less than the first predetermined compressive force. Preferably, the load sensitive internal component is an injection control valve for controlling the flow of fuel to the nozzle assembly. The injection control valve includes a center tube positioned in compressive abutment against the outer barrel by the second predetermined compressive force, and a control valve sleeve slidably mounted on the center tube. A low pressure fuel supply is provided and a bore is formed in the outer barrel for receiving a pump plunger. The pump plunger is reciprocally mounted in the bore for pressurizing the low pressure fuel to a high pressure level in a pumping chamber positioned at one end of the bore. The center tube includes a center passage for providing fuel flow between the pumping chamber and the nozzle housing. The control valve sleeve is movable between an open position permitting flow between the fuel supply and the pumping chamber and a closed position sealingly engaging an annular valve seat for blocking flow between the fuel supply and the pumping chamber. The control valve sleeve moves axially toward the nozzle assembly when moving into the closed position. The injection control valve further includes a biasing spring for biasing a control valve element into the open position. The center tube is preferably formed integrally on the spacer. The spacer includes a spring seat surface for supporting one end of the bias spring and a cylindrical extension extending from the spring seat surface into an inner radial extent of the bias spring for abutment against one end of the center tube.

Preferably, the retainer is formed as a single integral piece with the first connector portion including internal threads formed on the inner surface of the retainer for engaging complementary external threads formed on the outer barrel. The second connector portion preferably includes internal threads formed on the one piece retainer for engaging complementary external threads formed on the spacer.

The fuel injector of the present invention may include a locking device for ensuring secure engagement between the outer barrel and the first connector portion throughout reciprocation of the pump plunger as the load on the injector varies to ensure the desired minimal loading on the center tube. The locking device preferably includes a ring having threads on its inner surface for threadably engaging complementary threads formed on the outer surface of the outer barrel.

The fuel injector of the present invention also preferably includes an improved manner of aligning and sealing the connection between the center tube and the outer barrel. Specifically, the center tube includes a main portion, a sealing disc positioned at one end of the main portion for providing aligned sealing abutment against the outer barrel and a center fuel passage extending through the main portion and the sealing disc. The main portion includes a semi-spherical end surface whereas the sealing disc includes a frustoconically-shaped sealing end for sealing abutment against the semispherical end surface. The sealing disc also functions as a valve stroke setting device for setting a stroke distance of movement of the control valve sleeve between an open position and a closed position. The valve stroke setting function is achieved by selecting a sealing disc having a length which results in a total center tube length corresponding in the desired stroke distance.

DETAILED DESCRIPTION OF THE PREFERRED EMBODIMENT

Figure 1:
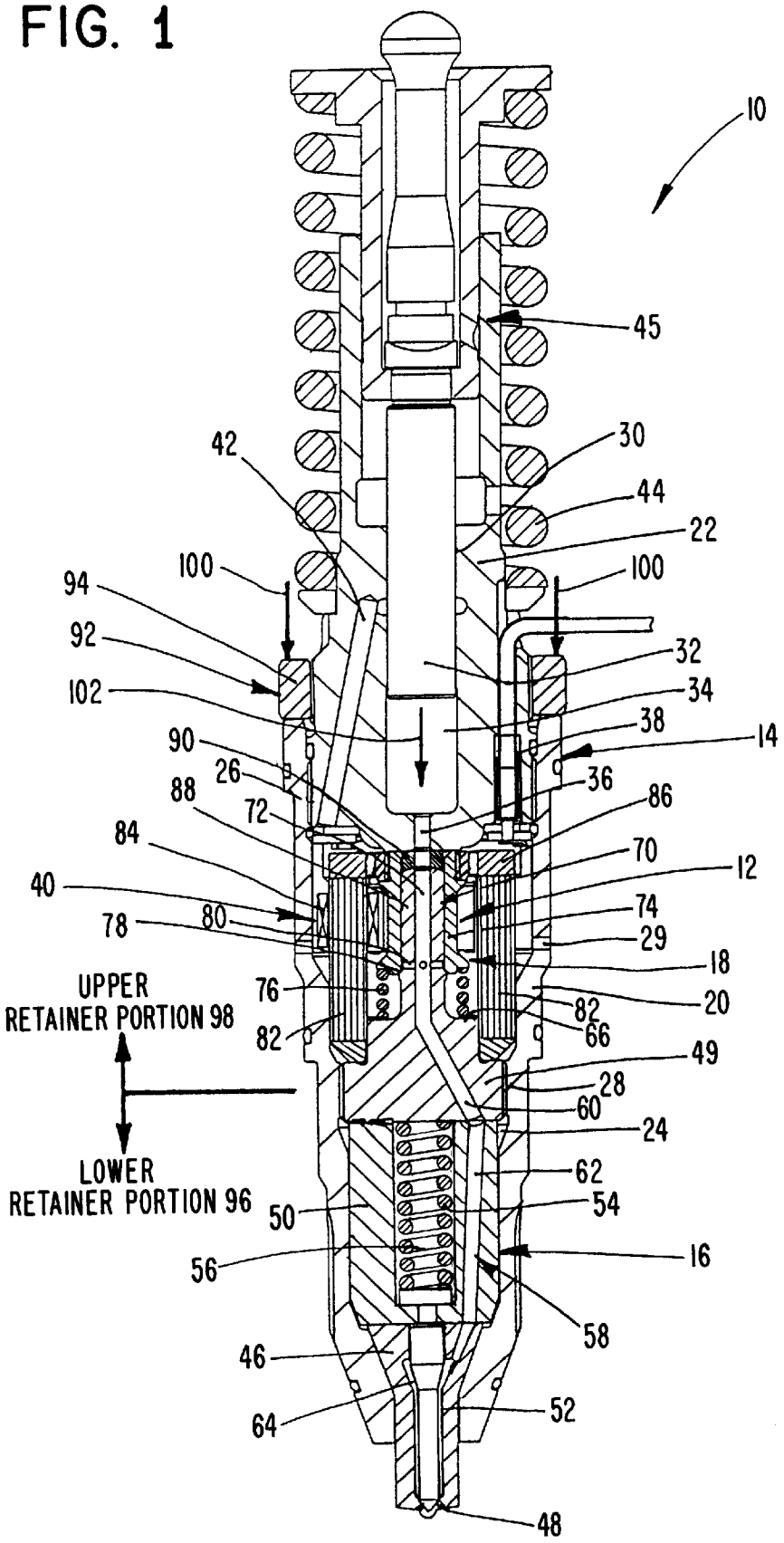
FIG. 1 is a cross-sectional view of a fuel injector designed in accordance with the preferred embodiment of the present invention.

Referring to FIG. 1, there is shown the fuel injector of the present invention, indicated generally at 10, which is designed to minimize the assembly and operational loads placed on a load sensitive internal component 12 mounted internally in fuel injector 10. Fuel injector 10 generally includes a load sensitive internal component 12, an injector body 14 and a nozzle assembly 16. Load sensitive internal component 12 is preferably a fuel injection control valve 18 for controlling the flow of high pressure fuel to nozzle assembly 16. However, load sensitive internal component 12 may be any injector component mounted in injector body 14 on which a predetermined or minimal amount of load should be applied during assembly and operation to achieve specific advantages. As discussed more fully hereinbelow, by reducing the assembly and operational loads on fuel injection control valve 18, the present injector reduces the required size of the fuel injection control valve 18 thereby reducing the size and weight of the injector while minimizing the likelihood of both load induced damage to the injection control valve and load induced adverse effects on the operation of the control valve.

Fuel injector body 14 includes a generally cylindrically shaped one-piece retainer 20 and an outer barrel 22. One-piece retainer 20 forms a retainer cavity 24 for receiving nozzle assembly 16 at one end and outer barrel 22 at an opposite end. Fuel injection control valve 18 is positioned in retainer cavity 24 between outer barrel 22 and nozzle housing 16. One-piece retainer 20 includes a first connector portion 26 comprised of internal threads for engaging complementary external threads formed on outer barrel 22 to securely connect outer barrel 22 to one-piece retainer 20 upon assembly. One-piece retainer 20 also includes a second connector portion 28 comprised of internal threads for engaging complementary threads formed on the outer surface of nozzle assembly 16 for securely mounting nozzle assembly 16 in retainer cavity 24 as discussed hereinbelow. One-piece retainer also includes a low pressure supply port 29 for supplying low pressure fuel to retainer cavity 24.

Outer barrel 22 includes a central bore 30 for receiving a pump plunger 32 reciprocally mounted in bore 30. A pump chamber 34 is formed between the inner end of pump plunger 32 and the inner end of bore 30 for receiving low pressure fuel for pressurization by pump plunger 32. A pump passage 36 extends through the inner end of outer barrel 22 to connect pump chamber 34 to passages formed in fuel injection control valve 18 as discussed more fully hereinbelow. Outer barrel 22 also includes a connector passage 38 for receiving an electrical connector for providing, for example, power to a solenoid assembly 40 of fuel injection control valve 18. Solenoid assembly 40 is used to operate injection control valve 18 as described more fully in U.S. Pat. No. 5,673,853, the entire contents of which is hereby incorporated by reference. Of course, any other type of actuator device could be used to operate injection control valve 18. Outer barrel 22 also includes a leak-by passage 42 for collecting fuel leaking through the clearance gap between pump plunger 32 and the inner surface of barrel 22 forming bore 30 and directing the leak-by fuel back to the low pressure supply in the retainer cavity 24. Also, a coil spring 44 is used in a conventional manner to bias pump plunger 32, via a link assembly 45, outwardly against an operating mechanism such as an overhead cam or rocker arm as is well known in the art.

As shown in FIG. 1, nozzle assembly 16 includes a nozzle valve housing 46 positioned in the inner end of retainer cavity 24 and extending outwardly through the inner end of one-piece retainer 20. Nozzle valve housing 46 includes injector orifices 48 for injecting fuel into the combustion chamber (not shown) of an engine. Nozzle assembly 16 also includes a spacer 49 having external threads for engaging the internal threads of second connector portion 28 and a spring housing 50 positioned for compressive abutment between spacer 49 and nozzle valve housing 46. A nozzle valve element 52 is mounted in nozzle valve housing 46 for controlling the flow of fuel through injector orifices 48. A nozzle spring 54 is positioned in a spring cavity 56 formed in spring housing 50 for biasing nozzle valve element 52 into a closed position blocking fuel flow through injector orifices 48. Spring housing 50, nozzle spring 54, nozzle valve housing 46 and nozzle valve element 52 may be of any conventional design for effectively biasing nozzle valve element 52 into the closed position between injection events while permitting nozzle valve element 52 to move into an open position when the fuel pressure acting on nozzle valve element 52 reaches a predetermined pressure level. Nozzle assembly 16 includes a fuel transfer circuit 58 for transferring high pressure fuel from injection control valve 18 to injector orifices 48. Fuel transfer circuit 58 includes a first passage 60 formed in spacer 49, a second passage 62 extending through spring housing 50 and a nozzle cavity 64 formed in nozzle valve housing 46. Of course, other types of closed nozzle valve assemblies could be used, such as any conventional rate shaping nozzle assembly.

Figure 2:
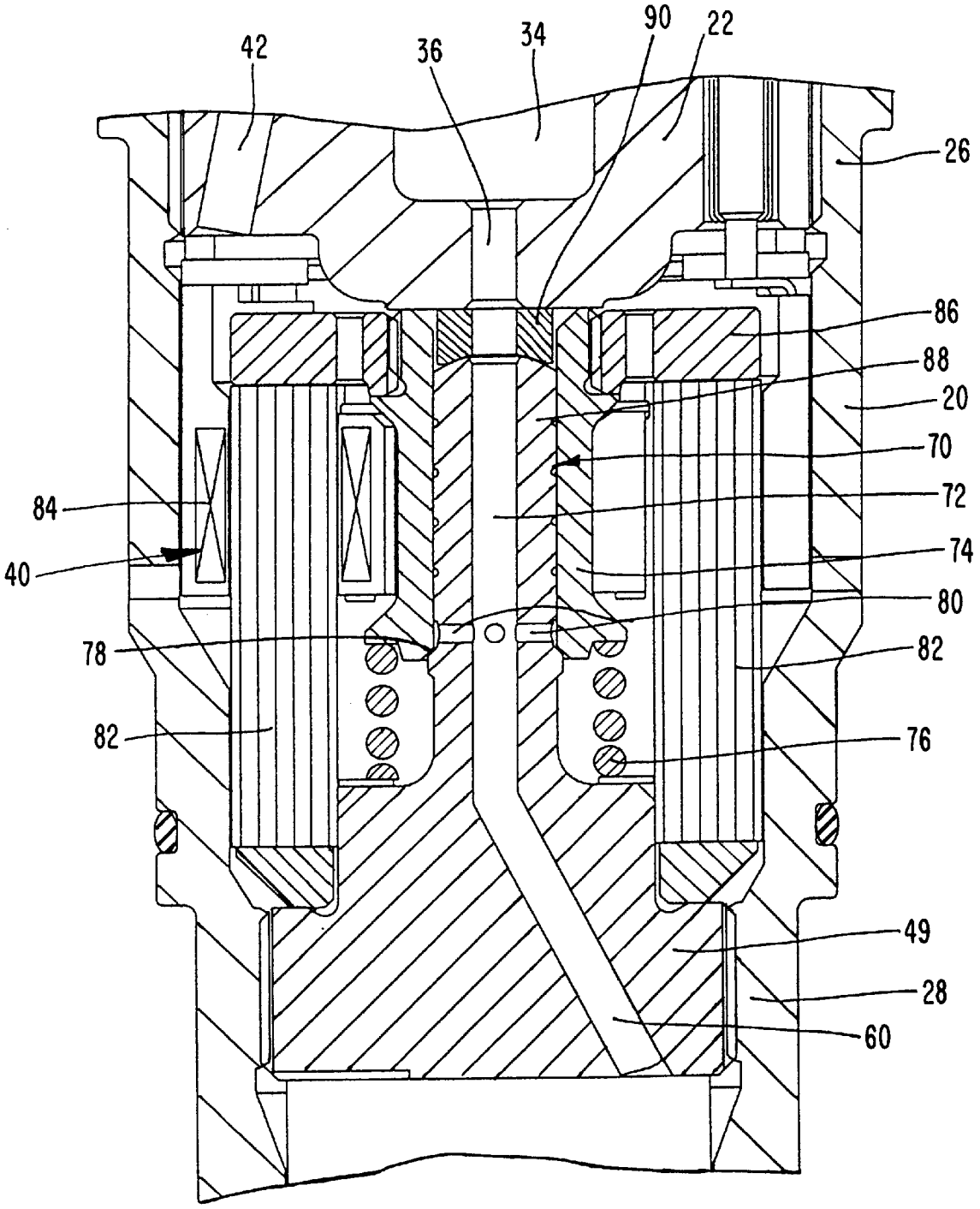
FIG. 2 is an enlarged view of the injection control valve portion of the injector of FIG. 1.

As best shown in FIG. 2, injection control valve 18 includes a center tube 70 integrally formed on spacer 49 and extending outwardly to form a distal end positioned for compressive abutment against outer barrel 22. By forming center tube 70 integrally with spacer 49, the present design advantageously eliminates one high pressure joint in the injector. Center tube 70 includes a center passage 72 communicating at one end with pump passage 36 and at an opposite end with first passage 60 of fuel transfer circuit 58. Injection control valve 18 also includes a control valve sleeve 74 reciprocally mounted on center tube 70 and biased outwardly away from spacer 49 by a biasing spring 76. One end of biasing spring 76 is supported by a spring seat surface 66 formed on spacer 49 so that center tube 70 extends through the inner radial extent of biasing spring 76. An annular valve seat 78 is formed on an intermediate portion of center tube 70 for sealing engagement by control valve sleeve 74 upon energization of solenoid assembly 40. Cross passages 80 extend radially outwardly from center passage 72 for providing fluidic communication between center passage 72 and the low pressure fuel supply when control valve sleeve 74 is in the open position. Thus, control valve sleeve 74 is biased into an open position by biasing spring 76 to permit low pressure fuel to flow between pump chamber 34 and the low pressure fuel supply while being movable into a closed position upon energization of solenoid assembly 40 so as to block communication between the low pressure fuel supply and both pump chamber 34 and fuel transfer circuit 58. The outer end of control valve sleeve 74 abuts the inner end of outer barrel 22 when control valve sleeve 74 is in the open position. It should be understood that although the preferred embodiment includes a solenoid actuated injection control valve 18, other conventional forms of actuator assemblies may be used to move control valve sleeve 74 into the closed position. In the present embodiment, solenoid assembly 40 includes pole pieces 82, alternately wrapped with wire in the form of coils 84, and an armature 86 connected to the outer end of control valve sleeve 74 and positioned adjacent pole pieces 82 as described in detail in U.S. Pat. No. 5,673,853.

Center tube 70 includes a main portion 88 and a sealing disc 90 mounted on the outer end of main portion 88 for providing an effective seal at the outer end of center tube 70 regardless of the tolerance differences between outer barrel 22, main portion 88 and spacer 49. The abutting faces of sealing disc 90 and main portion 88 are designed to permit sealing disc 90 to shift slightly relative to main portion 88 upon assembly to compensate for any tolerance differences between the components while sealingly engaging main portion 88 and outer barrel 22. Specifically, as shown in FIG. 2, the outer end of main portion 88 includes a semi-spherical end surface while the abutting surface of sealing disc 90 is frustoconically-shaped for self-aligning sealing engagement against the semi-spherical end surface of main portion 88. Thus, the outer end of sealing disc 90 can effectively abut outer barrel 22 to form an annular seal thereby preventing ineffective sealing due to tolerance differences while reducing manufacturing costs by avoiding the need for high precision manufacturing necessary to maintain extremely close manufacturing tolerances. In addition, sealing disc 90 may be used to set the valve stroke of control valve sleeve 74. Since the control valve sleeve 74 abuts outer barrel 22 to define the open position, increasing the length of center tube 70 causes control valve sleeve 74 to move a greater distance between the open and closed positions. Therefore, sealing disc 90 can be selected, or designed, with an axial length which, in combination with the length of main portion 88, creates a total center tube length resulting in a predetermined desired valve stroke distance.

Referring to FIG. 1, fuel injector 10 also includes a locking device 92 for ensuring a secure engagement between the threads of first connector portion 26 and outer barrel 22 throughout operation of the injector. Locking device 92 includes a locking ring 94 mounted on an outer end of one-piece retainer 20 adjacent outer barrel 22. Locking ring 94 includes internal threads for engaging complementary threads formed on the outer surface of outer barrel 22. Locking ring 94 is tightened or torqued after outer barrel 22 is connected to first connector portion 26 so as to place a locking load on the threaded connection between one-piece retainer 20 and outer barrel 22 thereby preventing other operational forces from disturbing this connection as discussed more fully hereinbelow.

Figure 3:
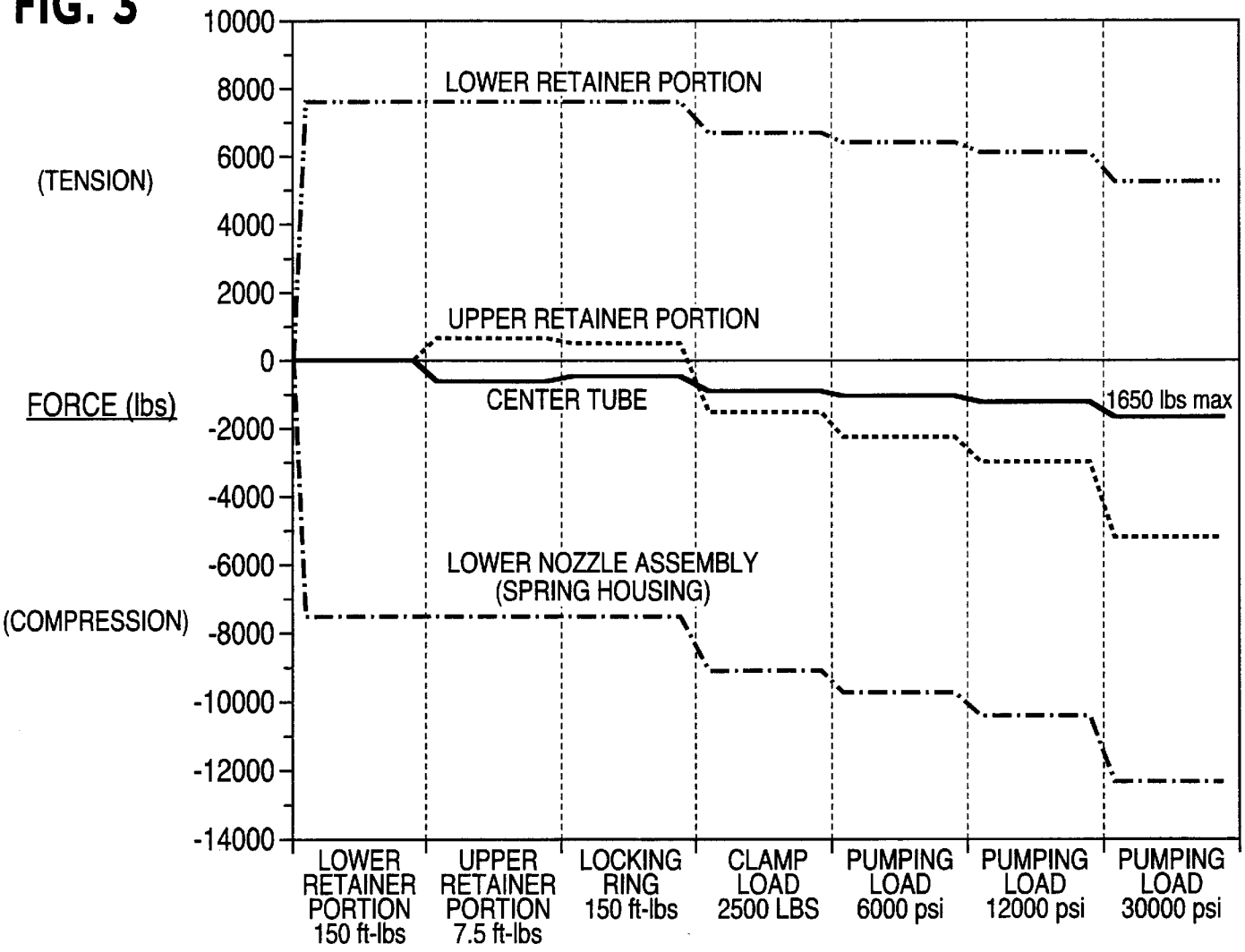
FIG. 3 is a graph illustrating the changes in compression and tension forces on the various portions of the injector of FIG. 1 during assembly and operation.

The injector design of the present invention effectively decouples the loads required to secure the components and seal the passages in the upper and lower portions of the injector so that each required load may be tailored to its optimum value thereby minimizing the size of the injection control valve and thus the injector. Specifically, as shown in FIG. 1, one-piece retainer 20 is divided into a lower retainer portion 96 and an upper retainer portion 98 by second connector portion 28. As a result, fuel injection control valve 18 can be subjected to a compressive load which is completely independent from the compressive load placed upon nozzle assembly 16. Specifically, upon assembly, nozzle valve housing 46 and spring housing 50 are inserted into retainer cavity 24 into the position shown in FIG. 1. Spacer 49 is then rotated so that the outer threads engage the inner threads of second connector portion 28. Spacer 49 is then torqued to a predetermined level, i.e. 150 ft-lbs, to place a compressive assembly load on spring housing 50 and nozzle valve housing 46 of, for example, 7500 pounds. As a result, lower retainer portion 96 experiences a reactive tension load of 7500 pounds. At this point, the upper retainer remains unloaded, as shown in FIG. 3 which plots the load in the various members at progressive stages of assembly and operation. Fuel injection control valve 18 is then inserted into retainer cavity 24 into the position shown in FIG. 1. Outer barrel 22 is then positioned in retainer cavity 24 and rotated to threadably engage the threads of first connector portion 26. Outer barrel 22 is then tightened or torqued to a predetermined level, i.e. 7.5 ft-lbs, so as to engage the outer end of sealing disc 90 and place a compressive load on center tube 70 which is substantially less than the compressive load placed on nozzle assembly 16. For example, as shown in FIG. 3, outer barrel 22 may be tightened to place a compressive load of approximately 750 pounds on center tube 70 which results in a counter tension force of 750 pounds on upper retainer portion 98. Thus, the loads required to seal the upper and lower portions of the injector have been decoupled to allow each load to be tailored to its optimum valve. As a result, a very large compressive load can be applied to nozzle assembly 16 to ensure effective sealing between the components while a compressive load of significantly less magnitude can be placed on center tube 70 of injection control valve 18. Consequently, center tube 70 can be formed with a smaller diameter, thereby reducing the size of injection control valve 18 and creating an overall more compact injector.

Center tube 70 must also be formed of sufficient material, i.e. with a sufficiently large diameter, capable of handling the increased compressive loads experienced upon mounting on an engine and during operation. Specifically, a clamping load indicated by arrows 100 in FIG. 1, is placed on one-piece retainer 20 by a conventional clamping or mounting device when injector 10 is, for example, bolted to an engine cylinder head. As shown in FIG. 3, the clamping load may be in the order of 2500 pounds. In addition, a pumping load 102 is placed on outer barrel 22 during each fuel injection event as pump plunger 32 pressurizes the fuel in pump chamber 34 to a high level causing the fuel pressure forces to act on the lower portion of outer barrel 22 forming pumping chamber 34. These pumping forces vary depending on engine operating conditions and the mode of operation of the engine.

Referring to FIG. 3, the injector design of the present invention effectively transmits a substantial portion of the clamping and pumping loads through one-piece retainer 20 thereby allowing only a small portion of the clamping and pumping loads to be transmitted to center tube 70. As shown in FIG. 3, the upper retainer takes most of the compressive load delivered by the clamping device and, as a result, transitions from a tension load to a compressive load. Then during operation, the pumping load is also primarily taken by the upper retainer. As shown in FIG. 3, the center tube 70 experiences only a small portion of the total clamping and pumping load placed on injector 10. The present injector effectively routes these axial loads through the upper retainer, as opposed to routing the loads through the center tube, by maintaining a secure connection between the threads of first connector portion 26 and the outer threads of outer barrel 22 using locking device 92 while making upper retainer portion 98 substantially stiffer than center tube 70.

Locking ring 94 of locking device 92 is threaded onto external threads formed on outer barrel 22 and torqued to a predetermined level, for example, 150 ft-lbs, as shown in FIG. 3, prior to clamping the injector on the engine. In effect, locking ring 94 places a securing load on the threaded connection between first connector portion 26 and the complementary threads of outer barrel 22. As a result, locking ring 94 prevents relative movement in, or loosening of, to any extent, the connection between upper retainer portion 98 and outer barrel 22 as injector 10 experiences cyclical pumping loads during the reciprocation of pump plunger 32 and engine vibration during engine operation. A secure, locked connection between first connector portion 26 and outer barrel 22 thus ensures that a substantial portion of the axial pumping and clamping loads are transferred through one-piece retainer 20 instead of center tube 70. Also, upper retainer portion 98 is much stiffer than center tube 70 due to its larger diameter and cross sectional area thereby providing the stiffness necessary to effectively transfer forces through the retainer without undesired bending or shifting causing the load to be transferred to the center tube.

Thus, the injector 10 of the present invention achieves several advantages over conventional fuel injectors having load sensitive internal components. First, the present injector effectively decouples the loads placed on the lower portion of the injector assembly and the load placed on the upper internal components thereby allowing each load to be independently tailored to an optimum value thus avoiding excessive loads on the load sensitive internal components. Consequently, the injector of the present invention minimizes the size of the load sensitive internal component, i.e. injection control valve 18, thereby minimizing the overall size of the fuel injector. Second, the fuel injector of the present invention routes a substantial portion of the clamping and pumping loads through the retainer thereby avoiding excessive loading of the load sensitive internal component and thus again permits a smaller component assembly. Third, the locking device 92 of the present invention ensures that a substantial portion of the clamping and pumping loads are not transferred to the load sensitive internal component throughout installation and operation of the injector by ensuring a secure, load transferring connection between one-piece retainer 20 and outer barrel 22. Consequently, not only may center tube 70 be designed with a minimum diameter, but this design prevents inadvertent loading of center tube 70 during operation thereby avoiding compression-induced expansion of, and/or damage to, center tube 70 thus preventing interruption in the effective operation of injection control valve 18. As should be understood, if undue loads are placed on center tube 70, radial expansion of center tube 70 may cause control valve sleeve 74 to bind on center tube 70 preventing movement of sleeve 74 and thus impairing the operation of control valve 18. Fourth, sealing disc 90 of the present invention functions to create a fluid seal between the distal end of center tube 70 and outer barrel 22 regardless of differences in manufacturing tolerances. In addition, sealing disc 90 functions as an effective valve stroke setting device for simply and easily setting the valve stroke of control valve sleeve 74. Also, the present design eliminates a high pressure joint by integrally forming center tube 70 on spacer 49.

INDUSTRIAL APPLICABILITY

The fuel injector heretofore described may be used in compression ignition and spark ignition engines of any vehicle or industrial equipment, but is particularly useful in engines where a compact injector having fast response and high pressure capability is essential. The present injector is also specifically useful in combination with an internal component which is sensitive to high loads.

What is claimed is:

1. A fuel injector adapted to inject fuel at high pressure into the combustion chamber of an engine, comprising:

an injector body including a one-piece retainer forming a retainer cavity and an outer barrel, said one-piece retainer including a first connector portion for secure engagement with said outer barrel and a second connector portion positioned along said one-piece retainer a spaced distance from said first connector portion;

a nozzle assembly mounted in one end of said retainer cavity and including a nozzle housing, an injector orifice formed in said nozzle housing for directing fuel into the combustion chamber, a nozzle valve element for controlling fuel flow through said nozzle orifice and a spacer securely connected to said second connector portion to cause said nozzle housing to compressively abut said one-piece retainer with a first predetermined compressive force; and a load sensitive internal component positioned in said retainer cavity axially between said spacer and said outer barrel, wherein said outer barrel engages said first connector portion to apply a second predetermined compressive force to said load sensitive internal component, said second predetermined compressive force being less than said first predetermined compressive force.

2. The fuel injector of claim 1, wherein said load sensitive internal component is an injection control valve means for controlling the flow of fuel to said nozzle assembly, said injection control valve means including a center tube positioned in compressive abutment against said outer barrel by said second predetermined compressive force, and a control valve sleeve slidably mounted on said center tube.

3. The fuel injector of claim 2, further including a low pressure fuel supply, a bore formed in said outer barrel, a pumping chamber positioned at one end of said bore for receiving low pressure fuel from said fuel supply and a pump plunger reciprocally mounted in said bore for pressurizing the low pressure fuel to a high pressure level, said center tube including a center passage for providing fuel flow between said pumping chamber and said nozzle housing, said control valve sleeve movable between an open position permitting flow between said fuel supply and said pumping chamber and a closed position sealingly engaging an annular valve seat for blocking flow between said fuel supply and said pumping chamber.

4. The fuel injector of claim 3, further including a locking means for ensuring secure engagement between said outer barrel and said first connector portion throughout reciprocation of said pump plunger.

5. The fuel injector of claim 4, wherein said locking means includes a ring having threads for threadably engaging complementary threads formed on said outer barrel.

6. The fuel injector of claim 2, wherein said first connector portion includes internal threads formed on said one-piece retainer for engaging complementary external threads formed on said outer barrel, said second connector portion including internal threads formed on said one-piece retainer for engaging complementary external threads formed on said spacer.

7. The injector of claim 2, wherein said center tube includes a main portion, a sealing disc positioned at one end of said main portion for providing aligned sealing abutment against said outer barrel and a center fuel passage extending through said main portion and said sealing disc.

8. The fuel injector of claim 7, wherein said main portion includes a semispherical end surface, said sealing disc including a frustoconically-shaped sealing end for sealing abutment against said semispherical end surface.

9. The fuel injector of claim 7, further including a valve stroke setting means for setting a stroke distance of movement of said control valve sleeve between an open position and a closed position, wherein said valve stroke setting means includes said sealing disc portion, said sealing disc portion having a length selectively chosen for setting said stroke distance.

10. A fuel injector adapted to inject fuel at high pressure into the combustion chamber of an engine, comprising:

an injector body including a retainer and an outer barrel, said retainer including a first connector portion for secure engagement with said outer barrel and a second connector portion positioned along said retainer a spaced distance from said first connector potion, said first connector portion including internal threads formed on said retainer for engaging complementary external threads formed on said outer barrel;

a nozzle assembly mounted adjacent one end of said retainer and including a nozzle housing, an injector orifice formed in said nozzle housing for directing fuel into the combustion chamber, a nozzle valve element for controlling fuel flow through said nozzle orifice and a spacer securely connected to said connector portion to cause said nozzle housing to compressively abut said retainer with a first predetermined compressive force, said second connector portion including internal threads formed on said retainer for engaging complementary external threads formed on said spacer;

a load sensitive internal component positioned axially between said spacer and said outer barrel, said outer barrel engaging said first connector portion to apply a second predetermined compressive force to said load sensitive internal component, said second predetermined compressive force being less than said first predetermined compressive force; and a locking means mounted on said injector body for ensuring secure engagement between said outer barrel and said first connector portion.

11. The injector of claim 10, wherein said locking means includes a ring having threads for threadably engaging complementary threads formed on said outer barrel.

12. The fuel injector of claim 10, wherein said load sensitive internal component is an injection control valve means for controlling the flow of fuel to said nozzle assembly, said injection control valve means including a center tube positioned in compressive abutment by said second predetermined compressive force against said outer barrel and a control valve sleeve slidably mounted on said center tube.

13. The fuel injector of claim 12, further including a low pressure fuel supply, a bore formed in said outer barrel, a pumping chamber positioned at one end of said bore for receiving low pressure fuel from said fuel supply and a pump plunger reciprocally mounted in said bore for pressurizing the low pressure fuel to a high pressure level, said center tube including a center passage for providing fuel flow between said pumping chamber and said nozzle housing, said control valve sleeve movable between an open position permitting flow between said fuel supply and said pumping chamber and a closed position sealingly engaging an annular valve seat for blocking flow between said fuel supply and said pumping chamber.

14. The fuel injector of claim 13, wherein said center tube includes a main portion, a sealing disc positioned at one end of said main portion for providing aligned sealed abutment against said outer barrel and a center fuel passage extending through said main portion and said sealing disc.

15. The fuel injector of claim 14, wherein said main portion includes a semispherical end surface, said sealing disc including a frustoconically-shaped sealing end for sealing abutment against said semispherical end surface.

16. The fuel injector of claim 13, wherein said control valve sleeve moves axially toward said nozzle assembly when moving into said closed position.

17. The injector of claim 16, wherein said injection control valve means further includes a biasing spring for biasing said control valve element into the open position, said spacer including a spring seat surface for supporting one end of said bias spring and a cylindrical extension extending from said spring support surface into an inner radial extent of said bias spring for abutment against one end of said center tube.

18. The fuel injector of claim 14, further including a valve stroke setting means for setting a stroke distance of movement of said control valve sleeve between an open position and a closed position, wherein said valve stroke setting means includes said sealing disc portion, said sealing disc portion having a length selectively chosen for setting said stroke distance.

19. A fuel injector adapted to inject fuel at a high pressure into the combustion chamber of an engine, comprising:

an injector body including a retainer forming a retainer cavity, an outer barrel and a fuel supply inlet;

a nozzle assembly mounted in one end of said retainer cavity and including a nozzle housing, an injector orifice formed in said nozzle housing for directing fuel into the combustion chamber, a nozzle valve element for controlling fuel flow through said nozzle orifice and a spacer securely connected to said retainer to cause said nozzle housing to compressively abut said retainer; and an injection control valve positioned in said retainer cavity axially between said spacer and said outer barrel for controlling the flow of fuel to said nozzle assembly, said injection control valve means including a center tube compressively positioned against said outer barrel, a center passage formed in said center tube for providing fuel flow through said center tube and a control valve sleeve slidably mounted on said center tube for controlling communication between said fuel supply inlet and said center passage, wherein said center tube includes a main portion having an end surface and a sealing disc portion positioned at one end of said main portion for sealingly abutting said outer barrel at one end and sealingly abutting said end surface at an opposite end.

20. The injector of claim 19, wherein said end surface is semispherically shaped, said sealing disc including a frustoconically-shaped sealing end for sealing abutment against said semispherical end surface.

21. The fuel injector of claim 19, further including a valve stroke setting means for setting a stroke distance of movement of said control valve sleeve between an open position and a closed position, wherein said valve stroke setting means includes said sealing disc portion, said sealing disc portion having a length selectively chosen for setting said stroke distance.

22. The injector of claim 19, further including a locking means for ensuring secure engagement between said outer barrel and said first connector portion throughout reciprocation of said pump plunger, said locking means including a ring having threads for threadably engaging complementary threads formed on said outer barrel.

23. The injector of claim 19, further including a bore formed in said outer barrel, a pumping chamber positioned at one end of said bore for receiving low pressure fuel from said fuel supply inlet and a pump plunger reciprocally mounted in said bore for pressurizing low pressure fuel to a high pressure level, wherein said control valve sleeve moves axially toward said nozzle assembly when moving into said closed position.

24. The injector of claim 19, wherein said main portion of said center tube is integrally formed on said spacer.

* * * * *